US005845610A

United States Patent [19]

Hatta et al.

[11] Patent Number: 5,845,610

[45] **Date of Patent: *Dec. 8, 1998**

[54] REFRACTORY PROTECTIVE BLOCKS AND PROTECTIVE WALL STRUCTURE OF BOILER USING SAME

[75] Inventors: Tokuaki Hatta, Souka; Hiromi Nakashima, Yokohama; Shigeru Imamura, Kisarazu; Arito Mizobe; Shigeki Ishimatsu, both of Kitakyushu; Akihiro Tachikawa, Kisarazu, all of Japan

[73] Assignees: Mitsubishi Jukogyo Kabushiki, Tokyo, Japan; Krosaki Corporation, Kitakyushu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 705,094

[22] Filed: Aug. 29, 1996

[30] Foreign Application Priority Data

Sep. 1, 1995 [JP] Japan ..... 7-225233

[51] Int. Cl.[6] ..... F22B 37/24

[52] U.S. Cl. ..... 122/510; 122/511; 122/6 A; 122/DIG. 13

[58] Field of Search ..... 122/510, 511, 122/512, 6 A, DIG. 13; 165/162

[56] References Cited

U.S. PATENT DOCUMENTS

| | | | |
|---|---|---|---|
| 4,245,694 | 1/1981 | Smith | 122/510 |
| 4,307,777 | 12/1981 | Chwyla | 122/510 |
| 4,412,510 | 11/1983 | Perry et al. | 122/510 |
| 4,706,614 | 11/1987 | Fournier et al. | 122/510 |
| 4,768,447 | 9/1988 | Roumeguere . | |
| 4,809,645 | 3/1989 | Fournier et al. | 122/6 A |
| 4,966,100 | 10/1990 | Fournier et al. | 122/6 A |
| 5,154,139 | 10/1992 | Johnson | 122/510 |
| 5,243,801 | 9/1993 | Alken . | |
| 5,542,378 | 8/1996 | Kubiak et al. | 122/510 |

OTHER PUBLICATIONS

Experience with Silicon–Carbide Tiles in Mass–Fired Refuse Boilers, Corrosion 93, The Nace Annual Conference and Corrosion Show, Paper No. 219, Larry Strach David T. Wasyluk, pp. 219/1 –219/10.

*Primary Examiner*—Teresa J. Walberg
*Assistant Examiner*—Jiping Lu
*Attorney, Agent, or Firm*—Amstrong Westerman, Hattori McLeland & Naughton

[57] ABSTRACT

A refractory protective block protects heat exchange means connecting tubes to fins. The refractory protective block has an inside complementary shape corresponding to the surface shape of the heat exchange means and the refractory protective block is provided with recesses into which projections formed on the tubes are fitted and received. A pair of projections formed on the two adjacent tubes in the heat exchange means are arranged so as to confront each other. The refractory protective block has a high durability which does not break even when heat exchange means expand more than the refractory block at the time of the repetition of heating and cooling and which enable the dispersion of strain at the time of the repetition of expansion and contraction.

9 Claims, 7 Drawing Sheets

C–C

D–D

REFRACTORY PROTECTIVE BLOCKS AND PROTECTIVE WALL STRUCTURE OF BOILER USING SAME

BACKGROUND OF THE INVENTION (i) Field of the Invention

The present invention relates to refractory protective blocks and a protective wall structure of a boiler using the same, and more specifically, it relates to refractory protective blocks which can suitably be used on the wall surface of a large boiler installed together with a municipal garbage incinerator, or the like, and a protective wall structure of the boiler using these blocks.

(ii) Description of the Related Art

In recent years, the amount of discharged municipal garbage inclusive of industrial waste has rapidly increased, and as one strategy for this problem, techniques regarding a municipal garbage incinerator for incinerating the combustible garbage have energetically been developed.

That is to say, combustion products in the municipal garbage incinerator include corrosive components such as a chlorine gas and alkalis, and these combustion products rapidly corrode metallic parts such as tubes and fins constituting heat exchangers of a boiler which are heat recovery means installed in the municipal garbage incinerator. For the prevention of this inconvenience, a refractory substance has been used as a covering material for protecting the tubes and the fins.

As this kind of covering material, a material which comprises a monolithic refractory comprising SiC particles and a binder as well as an anchor for supporting the refractory substance is practically excellent, and therefor such a material has been widely used.

In the case that the monolithic refractory is used, however, many steps are required for construction, and if some cracks occur in parts of the covering material, much labor is taken for repair. For these reasons, the technique of using the monolithic refractory is poor in construction efficiency and economy.

Thus, instead of the monolithic refractory, it has been investigated to use a shaped refractory (which are called blocks or tiles), and such a conception has been suggested in U.S. Pat. Nos. 5,243,801 and 4,768,447.

U.S. Pat. No. 5,243,801 has disclosed techniques regarding refractory tiles and protective covers for heat exchangers using these tiles, and the disclosed tiles are provided with the recesses of a complementary shape corresponding to T-shaped anchors, respectively, which are formed on the fins of the heat exchangers.

Furthermore, the refractory blocks of U.S. Pat. No. 4,768,447 can be applied to the vertical protective wall of a boiler, and in this boiler, the heat exchangers comprising the tubes and the fins are arranged in a vertical direction and the anchors are further attached to the fins. Moreover, the refractory blocks are provided with the recesses having a complementary shape corresponding to the anchors, respectively, and they are fitted into the anchors to support the spanning protective wall structure.

However, the refractory tiles described in U.S. Pat. No. 5,243,801 have the recesses having the complementary shape corresponding to the T-shaped anchors, and therefore, heat exchangers 20 made of a metallic material have a larger thermal expansion coefficient as compared with a refractory tile 30. In consequence, as shown in FIG. 9, tension is applied to the refractory tile 30 in a Y direction at the time of the repetition of heating and cooling, so that the refractory tile is liable to break.

Furthermore, the refractory blocks of U.S. Pat. No. 4,768,447 can be applied to the protective wall structure in the vertical direction, and in the case of the wall structure which slants from a vertical direction to a horizontal direction, there is a tendency that the refractory blocks separate from the heat exchangers owing to the weight of these blocks themselves, so that heat conductivity noticeably declines, which results in the deterioration of a heat recovery ratio.

SUMMARY OF THE INVENTION

The present invention has been developed in view of the above-mentioned problems of the conventional techniques, and an object of the present invention is to provide a refractory protective block which is seldom influenced by a corrosive gas and has an anchored structure in which the refractory protective block is attached to a heat exchanger and which do not break even when heat exchangers expand more than a refractory protective block at the time of the repetition of heating and cooling, and another object of the present invention is to provide a protective wall structure of a boiler in which a refractory protective block are used.

Still another object of the present invention is to provide refractory protective blocks which enable the dispersion of strain even at the time of the repetition of expansion and contraction and so which scarcely break and can conduct heat uniformly, and a further object of the present invention is to provide a protective wall structure of a boiler in which these refractory protective blocks are used.

According to the present invention, there are provided a refractory protective block for protecting heat exchange means containing tubes connected to fins, said refractory protective block having an inside complementary shape corresponding to the surface shape of the heat exchange means, said refractory protective block being provided with recesses into which projections formed on the tubes are fitted and received.

Furthermore, according to the present invention, there is provided a protective wall structure of a boiler which comprises heat exchange means containing tubes connected to fins and refractory protective blocks for protecting the heat exchange means, said refractory protective blocks having an inside complementary shape corresponding to the surface shape of the heat exchange means, said refractory protective blocks being provided with recesses into which projections formed on the tubes are fitted and received.

The planar shape of each of the refractory protective blocks is preferably hexagonal though it is generally rectangle, because such a hexagonal shape is hardly broken at the angle by oxidation of the surface and edges even if the surfaces and edges are brittle because of oxidation in comparison with a rectangular shape and can disperse and transmit strain caused by the repetition of expansion and contraction to adjoining blocks.

The refractory protective blocks are preferably formed so that the sectional shape of the refractory protective blocks cut at right angles to the axial direction of the tubes may be substantially corrugated, which inner circumference has the same center as the outer circumference does, and so that the thickness of the refractory protective blocks may be substantially uniform, because the stress concentration is hardly caused by the repetition of expansion and contraction, and heat can be uniformly transmitted, with the result that the breakage of the blocks scarcely takes place.

In addition, according to the present invention, there is provided a protective wall structure of a boiler which comprises heat exchange means containing tubes connected to fins and a plurality of refractory protective blocks for protecting the heat exchange means, the planar shape of each of a plurality of said refractory protective blocks being hexagonal, said refractory protective blocks having an inside complementary shape corresponding to the surface shape of the heat exchange means, said refractory protective blocks being provided with recesses into which projections formed on the tubes are fitted and received.

Specifically, a feature of the present invention is to minimize an influence of a corrosive gas and projection of a refractory protective block directly fixed on a tube.

In the present invention, a pair of projections may be mutually oriented laterally inwardly or outwardly with respect to the tube axis in view of attaching a refractory protective block to heat exchange means. A pair of projections may be disposed on one tube or on two adjacent tubes separately. When a pair of projections is disposed on one tube to position a block, the block is preferably made smaller so as to reduce a generated stress. In the present invention, a pair of projections formed on the respective of two adjacent tubes in the heat exchange means are preferably arranged so as to confront each other. According to such a structure, force to the blocks can be converted into compression stress by the structure, even if the refractory protective blocks are thermally shrunk prior to attachment to the heat exchange means, such as the tubes and the fins, during a cooling step. In consequence, the refractory protective blocks are resistant to breakage.

The refractory protective blocks of the present invention are preferably made of a material containing SiC as a main component, because such a material is more excellent in alkali resistance than any other oxides and they are not corroded by a chlorine gas, $SO_3$ and $NO_2$. In addition, such blocks have further advantages. For example, they are more excellent in oxidation resistance than any other non-oxidized substances, and they totally have the strongest resistance in the corrosive atmosphere of an incinerator.

BRIEF DESCRIPTION OF THE DRAWINGS

FIG. 4A is its sectional view and FIG. 4B is its plan view.

FIG. 12A is a plan view, and FIG. 12B is a cross-sectional view.

DESCRIPTION OF THE PREFERRED EMBODIMENTS

Now, the present invention will be described in more detail with reference to attached drawings.

Figure 1:
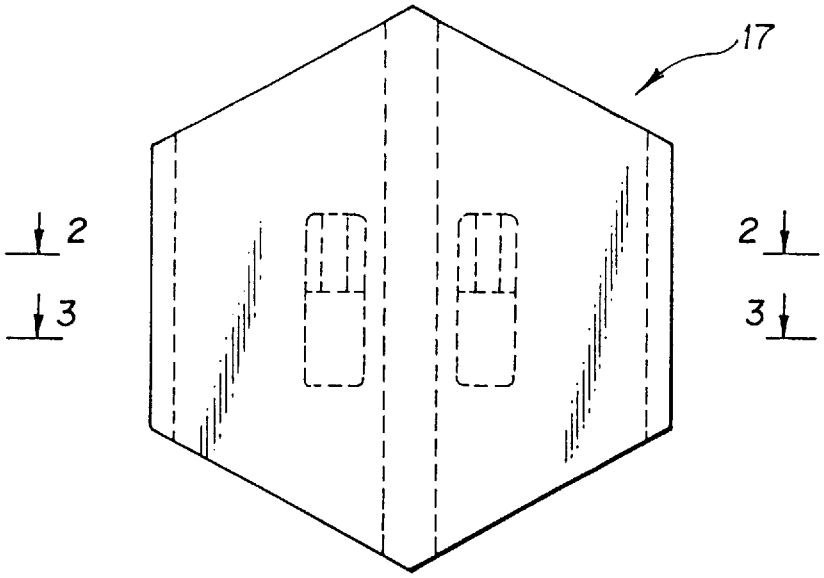
FIG. 1 is a plan view illustrating one embodiment of a refractory protective block of the present invention.
Figure 2:
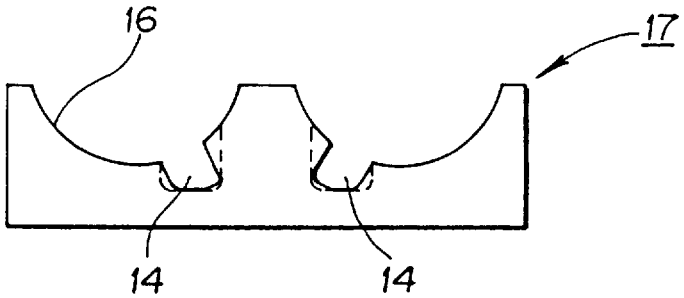
FIG. 2 is a sectional view cut along the line A—A in FIG. 1.
Figure 3:
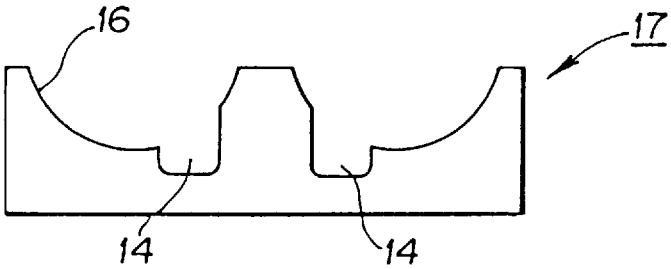
FIG. 3 is a sectional view cut along the line B—B in FIG. 1.
Figure 4A:
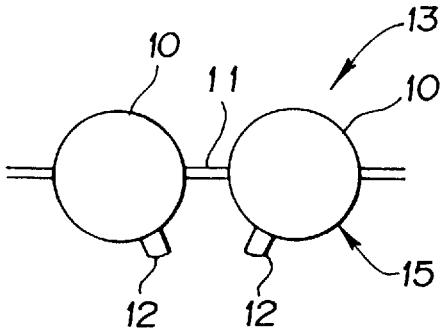
FIGS. 4A and 4B show one embodiment of heat exchange means of a boiler.
Figure 4B:
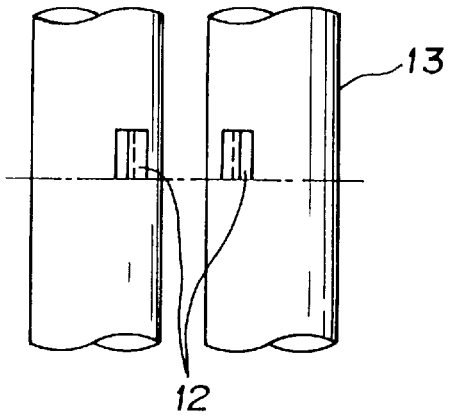
Figure 5:
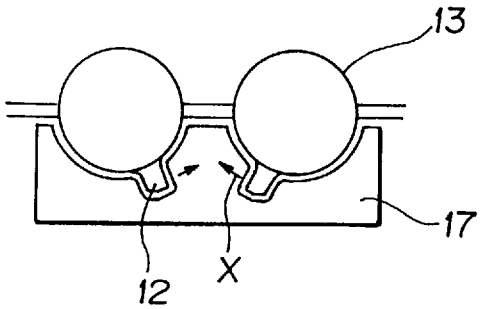
FIG. 5 is a sectional view illustrating one embodiment of a protective wall structure of the boiler in which the heat exchange means are covered with the refractory protective block.

FIGS. 1 to 3 show one embodiment of refractory protective blocks of the present invention. That is to say, FIG. 1 is its plan view, FIG. 2 is its sectional view cut along the line A—A in FIG. 1, and FIG. 3 is its sectional view cut along the line B—B in FIG. 1. FIGS. 4A and 4B show one embodiment of a heat exchange means of a boiler, and FIG. 4A is its sectional view and FIG. 4B is its plan view. FIG. 5 is a sectional view illustrating one embodiment of a protective wall structure for the boiler in which the heat exchange means are covered with the refractory protective block.

A heat exchange means 13 of a boiler or the like, as shown in FIGS. 4A and 4B, is constituted of a plurality of tubes 10 and fins 11 connecting the tubes 10 to each other, and each tube 10 is provided with a projection 12. A pair of projections 12 which are attached to the two adjacent tubes 10 are arranged so as to confront each other. On the other hand, a refractory protective block 17, as shown in FIGS. 1 to 3, has an inside complementary concave shape 16 corresponding to a convex surface shape 15 of the heat exchange means 13. Furthermore, the refractory protective block 17 is provided with a recess 14 into which the projection 12 attached on each tube 10 is fitted and received, which prevents the tube 10 from being detached from the refractory protective block 17.

The refractory protective block is firmly attached in to projections by pressing the projections to depressions 14*a* shown in FIG. 3 by a solid line and sliding the refractory block longitudinally of the tubes; so as to engage the projections with depressions 14 shown in FIG. 2 by a solid line.

As described above, the projection 12 is attached, not to the fin 11 but the tube 10, and the temperature of the tubes 10 is much lower than that of the fins 11, because a cooling medium flows through the tubes 10. Therefore, thermal stress generated from the projection 12 is lower than in a conventional embodiment in which anchors are attached on the fins. Further, the projection is scarcely influenced by a corrosive gas in a furnace because the temperature is low.

Figure 9:
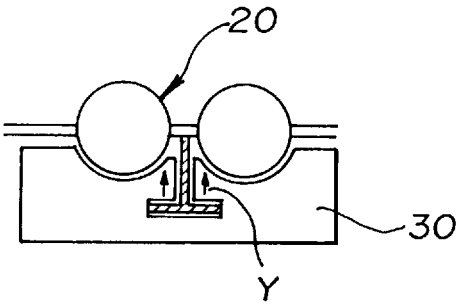
FIG. 9 is an illustrative view of a conventional refractory tile and T-type anchor.

FIG. 5 shows one embodiment of a protective wall structure of the boiler in which the heat exchanger means 13 are covered and protected with the thus constituted refractory protective block 17. As shown in FIG. 5, if the heat exchanger means 13 are covered with the refractory protective block 17, the stress is applied to the refractory protective block 17 in the directions of arrows X as shown in FIG. 5, even when the heat exchanger means 13 comprising the tubes 10 and the fins 11 thermally expand more than the refractory protective block 17 at a high temperature, because a pair of projections 12 formed on the two adjacent tubes 10 in the heat exchanger means 13 are arranged so as to confront each other. Consequently, instead of tension as shown in FIG. 9, compression stress is applied to the refractory protective block 17, and so the breakage of the refractory protective block 17 scarcely takes place.

Figure 6:
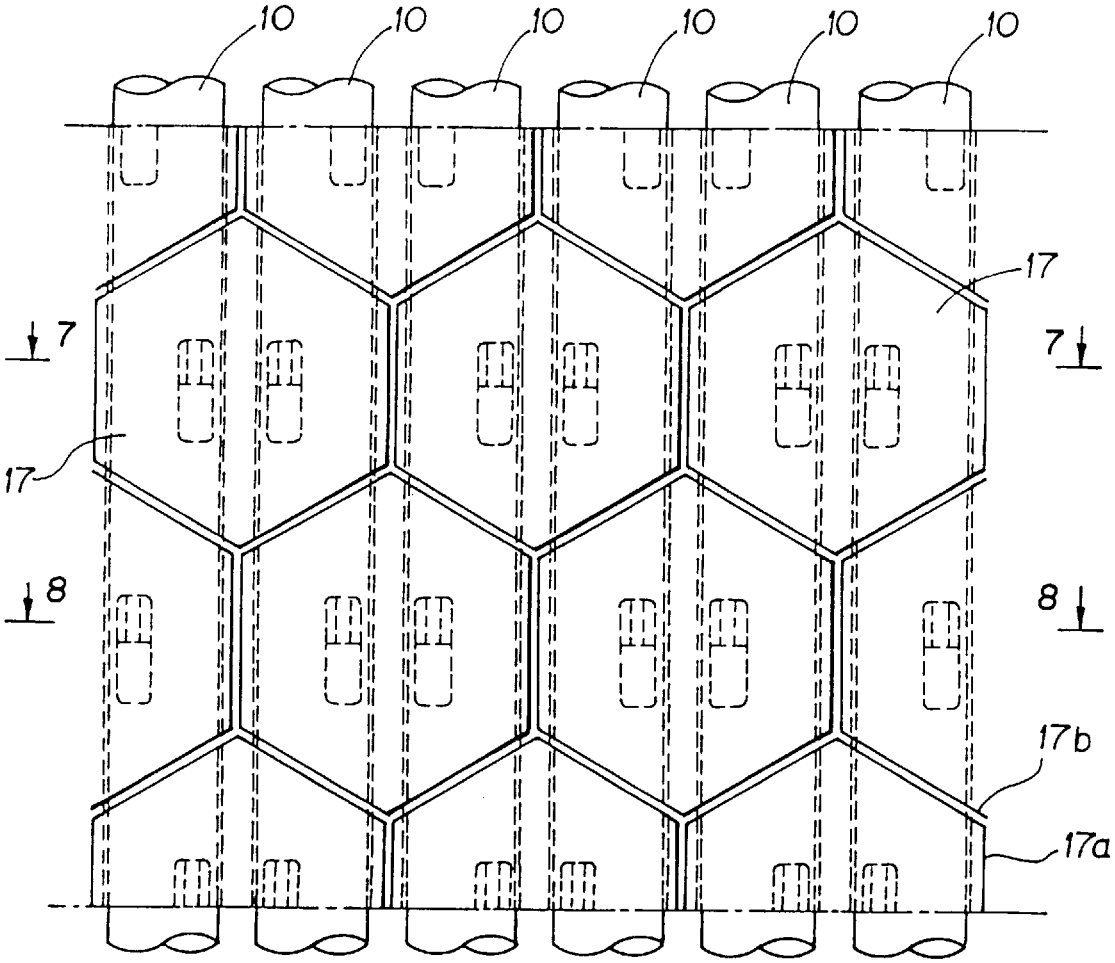
FIG. 6 is a partial plan view illustrating one embodiment of the protective wall structure of the boiler in which heat exchange means are protected by a plurality of the refractory protective blocks.
Figure 7:
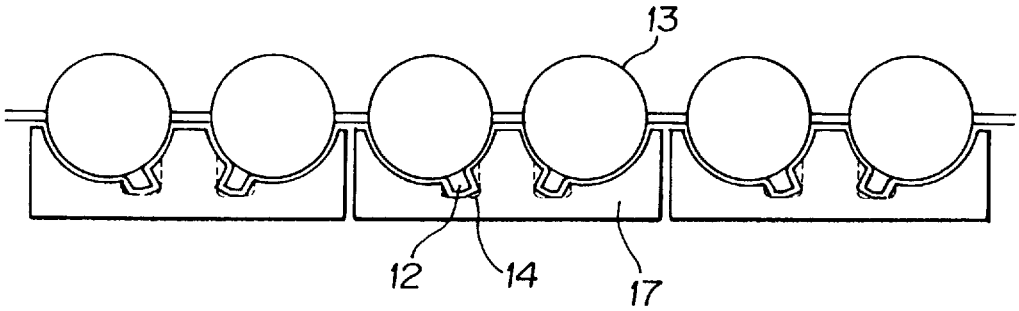
FIG. 7 is a sectional view cut along the line C—C in FIG. 6.
Figure 8:
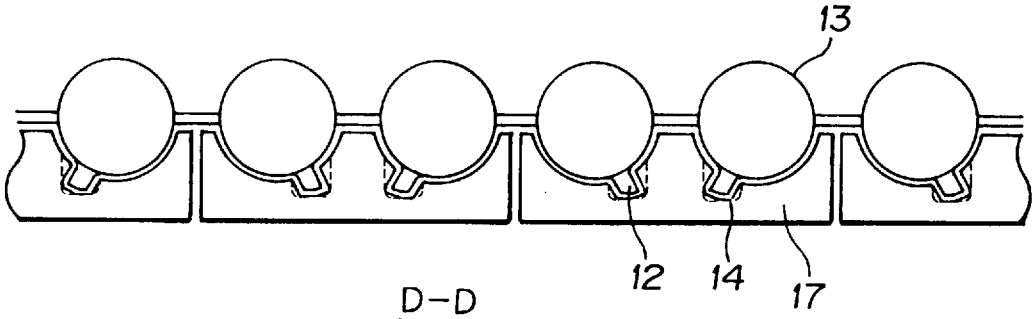
FIG. 8 is a sectional view cut along the line D—D in FIG. 6.

FIGS. 6 to 8 show one embodiment of the protective wall structure of the boiler in which the heat exchange means 13 are covered and protected with a plurality of the refractory protective blocks 17 whose planar shape of each block is hexagonal. FIG. 6 is a partial plan view, FIG. 7 is a sectional view cut along the line C—C in FIG. 6, and FIG. 8 is a sectional view cut along the line D—D in FIG. 6.

Figure 12B:
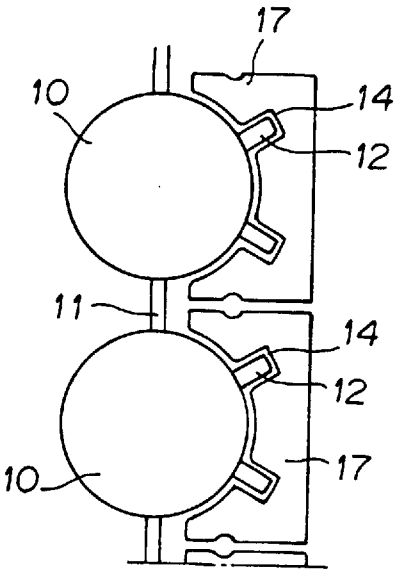
FIGS. 12A and 12B show an example of a refractory protective block which external form is rectangular.
Figure 12A:
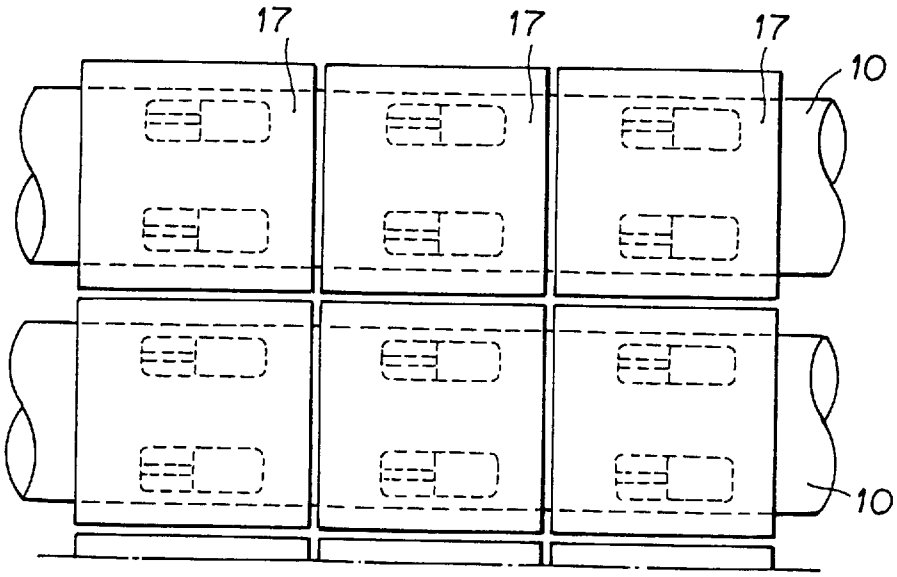
Figure 13:
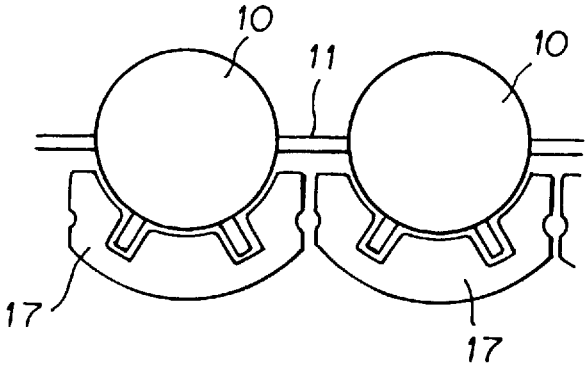
FIG. 13 is a cross-sectional view showing a uniform thickness of the block in the cross-section.

As shown in FIGS. 6 to 8, if the heat exchange means 13 are covered and protected with a plurality of the refractory protective blocks 17 whose planar shape is hexagonal, the danger of the breakage and the like of the blocks 17 can be reduced as much as possible even when the refractory protective blocks 17 expand at a high temperature and some strain occurs in these refractory protective blocks 17, because a part of the strain can be dispersed in directions along sides of the hexagon. On the contrary, in the case that the planar shape of each of the refractory protective blocks 17 is square, as shown in FIGS. 12A, 12B and 13, strain dispersal is reduced so that the breakage of the blocks more easily takes place and corners of the blocks are liable to be chipped off.

Figure 10:
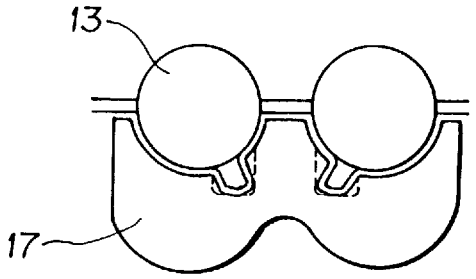
FIG. 10 is a sectional view illustrating another embodiment of a sectional shape of the refractory protective block cut at right angles to the axial direction of the tubes.

Furthermore, when the refractory protective blocks 17 are cut at right angles to the axial direction of the tubes 10, the sectional shape of the surfaces of the refractory protective blocks 17 opposite to the surface receiving the heat exchange means 13 may be flat, as shown in FIGS. 7 and 8. As shown in FIG. 10, however, the refractory protective blocks 17 are preferably formed so that the sectional shape of the surfaces of the refractory protective blocks 17 cut at right angles to the axial direction of the tubes 10 are corrugated, or so that the thickness of the refractory protective blocks 17 may be uniform, because in such a constitution, the stress caused by the repetition of expansion and contraction uniformly develops in each portion, and heat can be uniformly conducted and so the breakage of the blocks scarcely takes place and heat of the blocks is uniformly conducted.

In the end portions of the protective wall structure of the boiler partially shown in FIGS. 6 to 8, the refractory protective block 17 whose planar shape is hexagonal cannot be used, and therefore, for example, parts obtained by halving the refractory protective block 17 may be used, or a monolithic refractory which has been conventionally used may be used. Specifically, when halving the block, the refractory protective block 17 may be halved by a broken line 17*c*, as a halved block 17*a* of FIG. 6. The refractory protective block 17 may also be halved by a line connecting corners 17*b* of a hexagon facing each other.

Furthermore, a pair of projections 12 which are attached on the two adjacent tubes 10 are arranged so as to confront each other, and they are fitted into the recesses 14 of each refractory protective block 17, so that the compression stress is applied to the refractory protective block 17. In consequence, the refractory protective block 17 is resistant to breakage conveniently.

In addition, the one refractory protective block 17 covers and protects portions of adjacent tubes 10, and therefore, as shown in FIGS. 7 and 8, the adjacent refractory protective blocks 17 cover the alternately diverted tubes 10. Accordingly, when the one tube 10 is observed, the projections 12 attached to the tube 10 are alternately oppositely oriented. Since the stress develops in opposite directions due to the orientation of the projections and the stress extending in opposite directions works on each refractory protective block constituting a boiler protecting wall, there is no influence of stress between two adjoining refractory protective blocks. For this reason, the breakage of the refractory protective block 17 scarcely takes place.

In the protective wall structure of the boiler, mortar is introduced between the refractory protective blocks 17 and between the refractory protective block 17 and the heat exchange means 13 to bond them to each other. In this case, spacers formed of an anti-oxidizing material, or the like, may be interposed.

Figure 11:
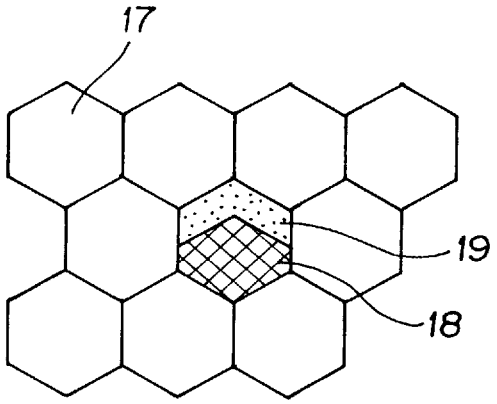
FIG. 11 is a partial plan view illustrating an embodiment in which a part of the protective wall structure of the boiler is repaired.

If the refractory protective block 17 which is a part of the protective wall structure of the boiler breaks and its exchange is required, a hexagonal refractory protective block 18 for repair having a plane area smaller than the usual refractory protective block 17 can be used and a mortar 19 is then filled into the remaining portion, as shown in FIG. 11, whereby the repair can be easily achieved.

No particular restriction is put on the kind of material for the refractory protective block regarding the present invention, so long as it is refractory. However, a material containing SiC as a main component is preferable, because such a material is excellent in oxidation resistance and alkali resistance, and what is better, it is not corroded by a chlorine gas, $SO_3$ and $NO_2$ and is sufficiently resistant to these substances, such gas-containing combustion of an incinerator and such gas in the incinerator. The SiC material is abundantly present as one of natural resources, and hence it is inexpensive and easily available.

As the heat exchange means covered and protested by the refractory protective blocks, there can usually be used a heat exchanger comprising the tubes and the fins, and a liquid, such as water, or a gas, such as a vapor, flows as a cooling medium through the tubes. As understood from the above, the heat exchange means is made of a metallic material having a good thermal conductivity in order to achieve the function of heat exchange.

The projections attached to the tubes have the so-called anchor function, and the attachment of these projections to the tubes can usually be done by welding means. Therefore, they are preferably made of a metallic material.

No particular restriction is put on the shape of the projections attached to the tubes, so far as they are outwardly extending protuberances having a predetermined length and a predetermined sectional area. Furthermore, no particular restriction is put on the position of the projections attached to the tubes, and they may be attached to any positions of the convex surfaces of the tubes corresponding to the inside surfaces of the refractory protective blocks.

Some embodiments of the present invention have been described above, but the scope of the present invention should not be limited at all to these embodiments. The present invention can be changed, modified and improved on the basis of the knowledge of a person skilled in the art without the deviation from the scope of the present invention.

As described above, according to the present invention, refractory protective blocks can be provided which are sufficiently resistant to a strongly corrosive combustion product and combustion gas produced at the operation of an incinerator, a boiler or the like and which are resistant to breakage and damage by the repetition of heat expansion and heat contraction, and a protective wall structure of the boiler can also be provided in which these blocks are used.

What is claimed is:

1. A refractory protective block for protecting heat exchange means including a plurality of mutually spaced tubes having parallel axes, intermediate fins filling the spaces between said tubes and projections extending from said tubes laterally with respect to the axes thereof, said refractory protective block comprising:

a body of refractory material containing an inside surface having a shape complementary to the outside surface of said heat exchange means, a pair of concave depressions for receiving said tubes of said heat exchange means, said depressions being formed on said inside surface of said block and having axes extending parallel to a longest axis of said block and symmetrical therewith, and a pair of concavities extending into surfaces of said refractory material body forming said depressions and being positioned between longitudinally spaced sides of said body, said concavities being of limited longitudinal extent parallel to said depressions and containing opposite ends which are closed, said concavities also containing a first portion formed of substantially rectangularly arranged sides, and a second portion longitudinally spaced from said first portion and communicating therewith, said second portion of each said concavity extending laterally with respect to the axis of said depressions for receiving said projections.

2. The refractory protective block according to claim 1 wherein said second portion of said concavities contains laterally confronting recesses for receiving a pair projections formed on two adjacent tubes in the heat exchange means.

3. The refractory protective block according to claim 1 wherein said body of refractory material is made of a material containing SiC as a main component.

4. The refractory protective block according to claim 1 wherein a peripheral shape of the refractory material body is hexagonal.

5. The refractory protective block according to claim 1 wherein a sectional shape of the refractory material body cut at right angles to the axial direction of the depressions for receiving tubes is corrugated, and a thickness of the refractory material body is substantially uniform.

6. A protective wall structure for a boiler containing heat exchange means including a plurality of tubes having their axes parallelly disposed and intermediately disposed fins welded to, and interconnecting, said tubes, said protective wall structure comprising:

a plurality of identically formed refractory protective blocks having an inside surface whose shape complements the external shape of said heat exchange means, projections formed on external surfaces of said tubes, said projections being elongated vertically only a limited length and disposed at alternately spaced locations along the length of adjacent tubes, and recesses formed on the inside surface of said refractory protective blocks, and disposed intermediate longitudinally spaced ends of said blocks said recesses being closed at opposite ends and each including a first portion formed of substantially rectangularly disposed sides and a second portion which complements and receives one of said projections, each said second portion being spaced axially from said first portion and connecting therewith.

7. A protective wall structure for a boiler according to claim 6 wherein said projections extend in an oppositely directed, laterally inclined direction with respect to the axis of the associated tube.

8. A protective wall structure for a boiler according to claim 7 wherein said first portions of said recesses are disposed vertically below said second portions.

9. A protective wall structure of a boiler containing heat exchange means including a plurality of tubes having their axes parallelly disposed and intermediately disposed fins welded to and interconnecting said tubes, said protective wall structure comprising:

a plurality of refractory protective blocks having a hexagonal peripheral shape and an inside surface whose shape complements the external shape of said heat exchange means, projections formed on an external surface of said tubes, said projections extending in a direction laterally inclined with respect to said tubes axis, and recesses formed on the inside surface of said refractory protective blocks conforming to and receiving said projections.

* * * * *